US007730683B2

(12) United States Patent
Koenig, Jr. et al.

(10) Patent No.: US 7,730,683 B2
(45) Date of Patent: Jun. 8, 2010

(54) CROWN MOLDING ASSEMBLY AND RELATED KIT

(75) Inventors: Joseph M. Koenig, Jr., Glenview, IL (US); Mark Budzik, Des Plaines, IL (US)

(73) Assignee: Trim-Tex, Inc., Lincolnwood, IL (US)

( * ) Notice: Subject to any disclaimer, the term of this patent is extended or adjusted under 35 U.S.C. 154(b) by 1423 days.

(21) Appl. No.: 11/120,938

(22) Filed: May 3, 2005

(65) Prior Publication Data

US 2006/0272237 A1 Dec. 7, 2006

(51) Int. Cl.
*E04F 19/00* (2006.01)

(52) U.S. Cl. ..... 52/288.1; 52/717.05; 52/718.01

(58) Field of Classification Search ..... 52/287.1, 52/288.1, 211, 272, 718.01, 718.04, 718.05, 52/717.03, 717.05, 220.5
See application file for complete search history.

(56) References Cited

U.S. PATENT DOCUMENTS

| | | | | |
|---|---|---|---|---|
| 906,218 | A | 12/1908 | Goddard | |
| 3,201,910 | A * | 8/1965 | Keesee | 52/287.1 |
| 3,616,587 | A | 11/1971 | Schafly, Jr. | |
| 5,398,469 | A | 3/1995 | Logan | |
| 5,433,048 | A * | 7/1995 | Strasser | 52/288.1 |
| 5,457,923 | A | 10/1995 | Logan et al. | |
| 5,463,835 | A * | 11/1995 | Wood | 52/288.1 |
| 6,477,818 | B1 | 11/2002 | Jensen | |
| 6,643,990 | B2 | 11/2003 | Jensen | |
| 6,911,597 | B2 * | 6/2005 | Seamans et al. | 52/220.5 |

OTHER PUBLICATIONS two pages copied from Trim-Tex 2003-2004 Catalog—see Stock Nos. 7208,7258,7250,7360,7068,7066,7062—admitted prior art.

* cited by examiner

*Primary Examiner*—Richard E Chilcot, Jr.
*Assistant Examiner*—Matthew J Smith
(74) *Attorney, Agent, or Firm*—Wood, Phillips, Katz, Clark & Mortimer

(57) ABSTRACT

A corner defined where a wall panel and a ceiling panel meet is trimmed by a crown molding assembly comprising a wall platform, a ceiling platform, a crown molding member, a wall edge-trimming bead, and a ceiling edge-trimming bead. The wall platform is affixed to the wall panel, at or near the corner, and has an expansive surface spaced from the wall panel. The ceiling platform is affixed to the ceiling panel, at or near the corner, and has an expansive surface spaced from the ceiling panel. The crown molding member is affixed so as to bridge the expansive surfaces of the wall and ceiling platforms. The wall edge-trimming bead is affixed so as to cover an outer edge of expansive surface of the wall platform. The ceiling edge-trimming bead is affixed so as to cover an outer edge of expansive surface of the ceiling platform. Each platform may comprise a drywall layer or stacked drywall layers. If either platform defines a step, the crown molding assembly further comprises another edge-trimming bead, which is affixed so as to cover an outer edge of the step.

17 Claims, 1 Drawing Sheet

CROWN MOLDING ASSEMBLY AND RELATED KIT

TECHNICAL FIELD OF THE INVENTION

This invention pertains to a crown molding assembly and to a related kit, each comprising a platform, a crown molding member, and en edge-trimming bead. The platform may comprise a drywall layer or stacked drywall layers. The crown molding member and the edge-trimming bead may be polymeric.

BACKGROUND OF THE INVENTION

As exemplified in U.S. Pat. No. 6,477,818 B1 and U.S. Pat. No. 6,643,990 B2, the disclosures of which are incorporated herein by reference, and in U.S. patent applications Ser. No. 10/850,225 and U.S. Ser. No. 10/774,798, the disclosures of which are incorporated herein by reference, it is known to make a crown molding member from a suitable polymeric material, such as polyvinyl chloride.

Typically, a crown molding member is used to trim a corner where a wall panel and a ceiling panel meet, so as to cover a strip that is several inches wide along the wall panel and so as to cover a strip that is several inches wide along the ceiling panel.

SUMMARY OF THE INVENTION

This invention provides a crown molding assembly and a related kit, each comprising a platform, a crown molding member, and an edge-trimming bead. The platform may comprise a drywall layer or stacked drywall layers. The crown molding member and the edge-trimming bead may be polymeric.

When this invention is embodied in a crown molding kit, the platform is adapted for being affixed to a panel selected from the wall panel and the ceiling panel, at or near the corner where the wall and ceiling panels meet. Further, the platform has an expansive surface that is spaced from the selected panel, after the platform has been affixed to the selected panel, by a distance not less than approximately three eighths inch. The expansive surface has an inner edge, which is disposed at or near the corner where the wall and ceiling panels meet when the platform is affixed to the selected panel, and an outer edge. The edge-trimming bead is adapted for being affixed so as to cover the outer edge.

The platform may define a step having an outer edge. If the platform comprises stacked drywall layers, the platform may define a step having an outer edge where one drywall layer extends beyond another drywall layer. If the platform defines a step having an outer edge, the crown molding kit comprises another edge-trimming bead, which is adapted for being affixed so as to cover the outer edge of the step.

The crown molding kit may comprise two platforms and two edge-molding members, namely, a wall platform and a wall edge-trimming bead, for which the wall panel is the selected panel, and a ceiling platform and a ceiling edge-trimming bead, for which the ceiling panel is the selected panel. Each of the platforms is similar to the platform described in the preceding paragraphs. Thus, each of the platforms may comprise a drywall layer or stacked drywall layers. Also, one of the platforms or each of the platforms may define a step having an outer edge. If either of the platforms or each of the platforms defines a step having an outer edge, the crown molding kit comprises, for each step, another edge-trimming bead, which is adapted for being affixed so as to cover the outer edge of the step. The edge-trimming bead or each of the edge-trimming beads is similar to the edge-trimming bead described in the preceding paragraphs.

This invention may be also embodied as a crown molding assembly trimming a corner where a wall panel and a ceiling panel meet. The crown molding assembly is similar to the crown molding kit described above. In the crown molding assembly, each crown molding kit element described above as being adapted for being affixed to a different element is affixed to the different element, as and where described above.

DETAILED DESCRIPTION OF THE INVENTION

Figure 1:
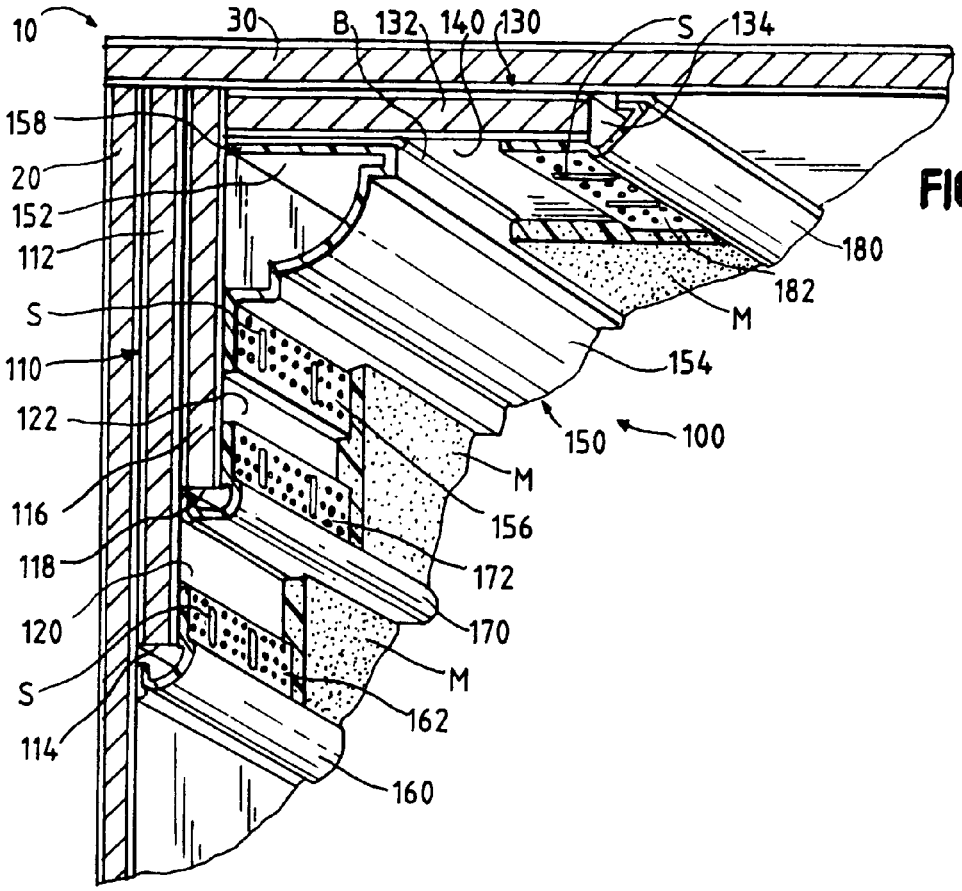
FIG. 1 is a partially cut away, isometric view of a crown molding assembly constituting a first embodiment of this invention.

As illustrated in FIG. 1, a corner 10, which is defined where a wall panel 20 and a ceiling panel 30 meet, is trimmed by a crown molding assembly 100 constituting a first embodiment of this invention. The panels 20, 30, are drywall panels. Commonly, in the United States, a drywall layer has a nominal thickness of one half inch or of five eighths inch.

The crown molding assembly 100 comprises a wall platform 110, which comprises an inner drywall layer 112 affixed adhesively or otherwise to the wall panel 20, at the corner 10, so as to extend downwardly from the ceiling panel 30 to an outer edge 114 of the inner drywall layer 112, and an outer drywall layer 116 affixed adhesively or otherwise to the inner drywall layer 112, near the corner 10, so as to extend downwardly from the ceiling panel 30. The drywall layers 112, 116, which are cut from a drywall panel similar to the drywall panels 20, 30, are regarded as being stacked.

The inner drywall layer 112 extends downwardly beyond the outer drywall layer 116, whereby an outer edge 114 of the inner drywall layer 112 is spaced downwardly below an outer edge 118 of the outer drywall layer 116, and whereby the wall platform 110 defines a step 120 having, as its outer edge, the outer edge 114 of the inner drywall layer 112. The outer drywall layer 116 defines an outwardly facing, expansive surface 122 of the wall platform 110. The expansive surface 122 has, as its outer edge, the outer edge 118 of the outer drywall layer 116.

The crown molding assembly 100 comprises a ceiling platform 130, which comprises a single drywall layer 132 affixed adhesively or otherwise to the ceiling panel 30, near the corner 10, so as to extend horizontally from the outer drywall layer 116 of the wall platform 110 to an outer edge 134 of the single drywall layer 132. The single drywall layer 132, which is cut from a drywall panel, defines a downwardly facing, expansive surface 140 of the ceiling platform 130. The expansive surface 140 has, as its outer edge, the outer edge 134 of the single drywall layer 132.

The crown molding assembly 100 comprises a crown molding member 150, which is extruded from a suitable polymer, such as polyvinyl chloride, and which may conform to one of the crown molding members disclosed in U.S. patent applications Ser. No. 10/850,225 and Ser. No. 10/774,798, supra. As illustrated in FIG. 1, the crown molding member 150 comprises a planar portion 152, an intermediate portion 154, and a mounting flange 156. The crown molding member 150 is affixed so as to bridge the expansive surfaces 120, 140, of the wall and ceiling platforms 110, 130.

As illustrated in FIG. 1, the planar portion 152 is disposed beneath and against the expansive surface 140 of the ceiling platform 130, so that one edge 158 of the planar portion 152, away from where the planar portion 152 meets the intermediate portion 154, bears against the expansive surface 120 of the wall platform 110, and is tacked to the expansive surface 140 of the ceiling platform 130, via a caulk bead B along the opposite edge 160 of the planar portion 152, where the planar portion 152 meets the intermediate portion 154. Moreover, mounting flange 156 is affixed mechanically, via staples S having diverging legs, and adhesively to the expansive surface 120 of the wall platform 110.

The crown molding assembly 100 comprises an edge-trimming bead 160 having a mounting flange 162, which is affixed mechanically, via staples S having diverging legs, and adhesively to the step 126 of the wall platform 110, so as to cover the outer edge 114 of the step 126 of the wall platform 110, an edge-trimming bead 170 having a mounting flange 172, which is affixed mechanically, via staples S having diverging legs, and adhesively to the expansive surface 122 of the wall platform 110, so as to cover the outer edge 118 of the expansive surface 120 of the wall platform 110, and an edge-trimming bead 180 having a mounting flange 182, which is affixed mechanically, via staples S having diverging legs, and adhesively to the expansive surface 140 of the ceiling platform 130, so as to cover the outer edge 134 of the ceiling platform 130. Polymeric edge-trimming beads, which are suitable as the edge-trimming beads 160, 170, 180, are available commercially from Trim-Tex, Inc. of Lincolnwood, Ill.

So as to finish the crown molding assembly 100, drywall-finishing material M, so-called "mud" in trade parlance, is applied so as to cover the mounting flange 162 of the edge-trimming bead 160 and the step 120 above the mounting flange 162, so as to cover the mounting flange 172 of the edge-trimming bead 170, the mounting flange 156 of the crown molding member 150, and the expansive surface 120 between the mounting flanges 162, 172, and so as to cover the mounting flange 182 of the edge-trimming bead 180, the caulk bead B, and the expansive surface 140 between the mounting flange 182 and the caulk bead B.

Figure 2:
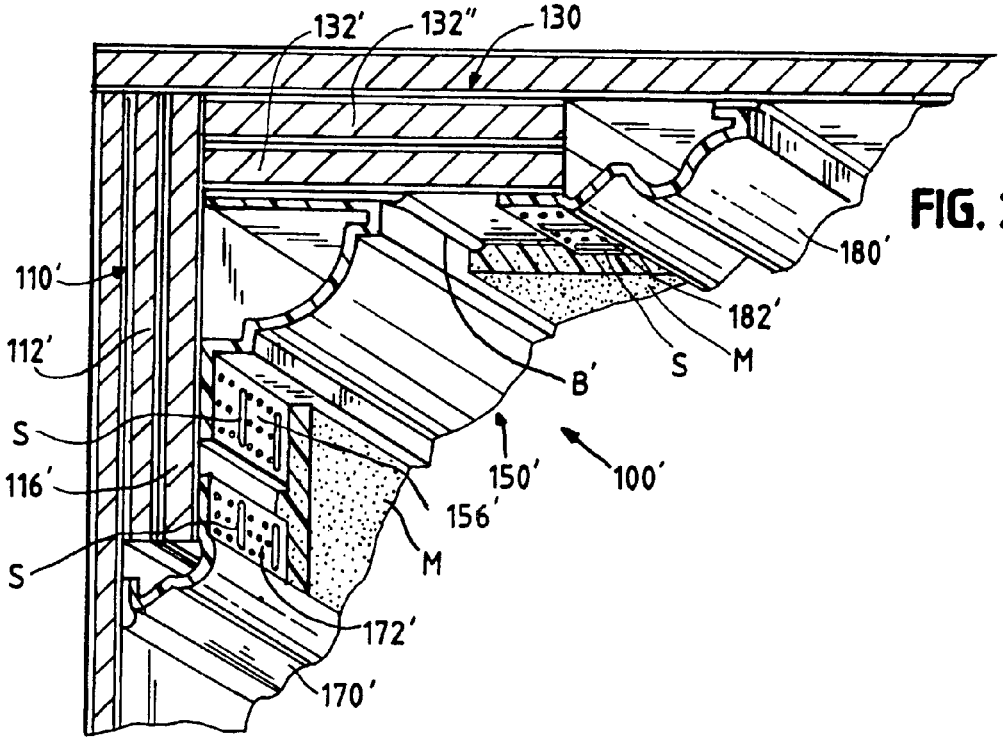
FIG. 2 is a similar view of crown molding assembly constituting a second embodiment of this invention.

As illustrated in FIG. 2, a crown molding assembly 100' is similar to the crown molding assembly 100 and is used similarly, except as described below. The crown molding assembly 110' has a wall platform 110', which is similar to the wall platform 110, except that the inner drywall layer 112' of the wall platform 110' does not extend beyond the outer drywall layer 116' of the wall platform 110'. The crown molding assembly 110' has a ceiling platform 130', which is similar to the ceiling platform 130, except that the ceiling platform 130' has two stacked drywall layers, namely, an inner drywall layer 132" and an outer drywall layer 132', neither of which extends beyond the other. The crown molding assembly 110' has a crown molding member 150', which is similar to the crown molding member 150, which is affixed similarly to the wall platform 110', and which is tacked similarly to the ceiling platform 130', via a caulk bead B' similar to the caulk bead B.

The crown molding assembly 100' comprises an edge-trimming bead 170' having a mounting flange 172', which is affixed mechanically, via staples S having diverging legs, and adhesively to the expansive surface 120' of the wall platform 110', so as to cover the outer edge 122' of the expansive surface 120' of the wall platform 110', and an edge-trimming bead 180' having a mounting flange 182', which is affixed mechanically, via staples S having diverging legs, and adhesively to the expansive surface 140' of the ceiling platform 130', so as to cover the outer edge 134' of the ceiling platform 130'. Polymeric edge-trimming beads, which are suitable as the edge-trimming beads 170', 180', are available commercially from Trim-Tex, Inc, of Lincolnwood, Ill.

So as to finish the crown molding assembly 100', drywall-finishing material M, so-called "mud" in trade parlance, is applied so as to cover the mounting flange 172' of the edge-trimming bead 170', the mounting flange 156' of the crown molding member 150', and the expansive surface 120' between the mounting flanges 156', 172', and so as to cover the mounting flange 182' of the edge-trimming bead 180', the caulk bead B', and the expansive surface 140' between the mounting flange 182' and the caulk bead B'.

Each of the crown molding assemblies 100, 100', may be regarded as having been made from a crown molding kit, which comprises the platform or platforms described above, the crown molding member described above, and the edge-trimming beads described above.

The invention claimed is:

1. A crown molding kit for trimming a corner defined where a wall panel and a ceiling panel meet, wherein the crown molding kit comprises a platform, which is adapted for being affixed to a panel selected from the wall and ceiling panels, at or near the corner, wherein the platform has an expansive surface spaced from the selected panel, after the platform has been affixed to the selected panel, wherein the expansive surface has an inner edge and an outer edge, wherein the inner edge is disposed at or near the corner when the platform is affixed to the selected panel, wherein the crown molding kit further comprises a crown molding member, which is adapted for being affixed directly to the expansive surface of the platform, and an edge-trimming bead, which is adapted for being affixed so as to cover the outer edge of the expansive surface of the platform.

2. A crown molding kit for trimming a corner defined where a wall panel and a ceiling panel meet, wherein the crown molding kit comprises a platform, which is adapted for being affixed to a panel selected from the wall and ceiling panels, at or near the corner, wherein the platform has an expansive surface spaced from the selected panel, after the platform has been affixed to the selected panel, wherein the expansive surface has an inner edge and an outer edge, wherein the inner edge is disposed at or near the corner when the platform is affixed to the selected panel, wherein the crown molding kit further comprises a crown molding member, which is adapted for being affixed to the expansive surface of the platform, and an edge-trimming bead, which is adapted for being affixed so as to cover the outer edge of the expansive surface of the platform, wherein the platform defines a step having an outer edge, and wherein the crown molding kit further comprises another edge-trimming bead, which is adapted for being affixed so as to cover the outer edge of the step.

3. The crown molding kit of claim 2, wherein the platform comprises stacked drywall layers and wherein the step is defined by one said layer extending beyond another said layer.

4. A crown molding kit for trimming a corner defined where a wall panel and a ceiling panel meet, wherein the crown molding kit comprises a wall platform, which is adapted for being affixed to the wall panel, at or near the corner, wherein the wall platform has an expansive surface parallel to and spaced from the wall panel, after the wall platform has been affixed to the wall panel, wherein the expansive surface of the wall platform has an inner edge and an outer edge, wherein the inner edge of the expansive surface of the wall platform is disposed at or near the corner when the wall platform is affixed to the wall panel, wherein the crown molding kit comprises a ceiling platform, which is adapted for being affixed to the ceiling panel, at or near the corner, wherein the ceiling platform has an expansive surface parallel to and spaced from the ceiling panel, after the ceiling platform has been affixed to the wall panel, wherein the expansive surface of the ceiling platform has an inner edge and an outer edge, wherein the inner edge of the expansive surface of the ceiling platform is disposed at or near the corner when the ceiling platform is affixed to the ceiling panel, wherein the crown molding kit further comprises a crown molding member, which is adapted for being affixed so as to bridge the expansive surfaces of the wall and ceiling platforms, a wall edge-trimming bead, which is adapted for being affixed so as to cover the outer edge of expansive surface of the wall platform, and a ceiling edge-trimming bead, which is adapted for being affixed so as to cover the outer edge of expansive surface of the ceiling platform.

5. The crown molding kit of claim 4, wherein at least one of the wall and ceiling platforms is stepped so as to define a step having an outer edge, and wherein the crown molding kit further comprises, for each step, another edge-trimming bead, which is adapted for being affixed to the at least one said platform so as to cover the outer edge of said step.

6. The crown molding kit of claim 5, wherein each platform comprises stacked drywall layers and wherein each step is defined by one said layer extending beyond another said layer.

7. The crown molding kit of claim 4, wherein each platform comprises stacked drywall layers.

8. A crown molding kit for trimming a corner defined where a wall panel and a ceiling panel meet, wherein the crown molding kit comprises a platform, which is adapted for being affixed to a panel selected from the wall and ceiling panels, at or near the corner, wherein the platform has an expansive surface spaced from the selected panel, after the platform has been affixed to the selected panel, wherein the expansive surface has an inner edge and an outer edge, wherein the inner edge is disposed at or near the corner when the platform is affixed to the selected panel, wherein the crown molding kit further comprises a crown molding member, which is adapted for being affixed to the expansive surface of the platform, and an edge-trimming bead, which is adapted for being affixed so as to cover the outer edge of the expansive surface of the platform, wherein the platform comprises a drywall layer or stacked drywall layers.

9. The crown molding kit of any one of claims 1 through 6, wherein the crown molding member and each edge-trimming bead are polymeric.

10. A crown molding assembly trimming a corner where a wall panel and a ceiling panel meet, wherein the crown molding assembly comprises a platform, which is affixed to a panel selected from the wall and ceiling panels, at or near the corner, wherein the platform has an expansive surface spaced from the selected panel, wherein the expansive surface has an inner edge and an outer edge, wherein the inner edge is disposed at or near the corner, wherein the crown molding assembly further comprises a crown molding member, which is affixed directly to the expansive surface of the platform, and an edge-trimming bead, which is affixed so as to cover the outer edge of the expansive surface of the platform.

11. A crown molding assembly trimming a corner where a wall panel and a ceiling panel meet, wherein the crown molding assembly comprises a platform, which is affixed to a panel selected from the wall and ceiling panels, at or near the corner, wherein the platform has an expansive surface spaced from the selected panel, wherein the expansive surface has an inner edge and an outer edge, wherein the inner edge is disposed at or near the corner, wherein the crown molding assembly further comprises a crown molding member, which is affixed to the expansive surface of the platform, and an edge-trimming bead, which is affixed so as to cover the outer edge of the expansive surface of the platform, wherein the platform defines a step having an outer edge, and wherein the crown molding kit further comprises another edge-trimming bead, which is affixed so as to cover the outer edge of the step.

12. The crown molding assembly of claim 11, wherein the platform comprises stacked drywall layers and wherein the step is defined by one said layer extending beyond another said layer.

13. A crown molding assembly trimming a corner defined where a wall panel and a ceiling panel meet, wherein the crown molding assembly comprises a wall platform, which is affixed to the wall panel, at or near the corner, wherein the wall platform has an expansive surface parallel to and spaced from the wall panel, wherein the expansive surface of the wall platform has an inner edge and an outer edge, wherein the inner edge of the expansive surface of the wall platform is disposed at or near the corner, wherein the crown molding assembly comprises a ceiling platform, which is affixed at or near the corner, wherein the ceiling platform has an expansive surface spaced from the ceiling panel, wherein the expansive surface of the ceiling platform has an inner edge and an outer edge, wherein the inner edge of the expansive surface of the ceiling platform is disposed at or near the corner, wherein the crown molding assembly further comprises a crown molding member, which is affixed so as to bridge the expansive surfaces of the wall and ceiling platforms, a wall edge-trimming bead, which is affixed so as to cover the outer edge of expansive surface of the wall platform, and a ceiling edge-trimming bead, which is affixed so as to cover the outer edge of expansive surface of the ceiling platform, wherein at least one of the wall and ceiling platforms is stepped so as to define a step having an outer edge, and wherein the crown molding assembly further comprises, for each step, another edge-trimming bead, which is affixed so as to cover the outer edge of said step.

14. The crown molding assembly of claim 13, wherein each platform comprises stacked drywall layers.

15. The crown molding kit of claim 13, wherein each platform comprises stacked drywall layers and wherein each step is defined by one said layer extending beyond another said layer.

16. A crown molding assembly trimming a corner where a wall panel and a ceiling panel meet, wherein the crown molding assembly comprises a platform, which is affixed to a panel selected from the wall and ceiling panels, at or near the corner, wherein the platform has an expansive surface spaced from the selected panel, wherein the expansive surface has an inner edge and an outer edge, wherein the inner edge is disposed at or near the corner, wherein the crown molding assembly further comprises a crown molding member, which is affixed to the expansive surface of the platform, and an edge-trimming bead, which is affixed so as to cover the outer edge of the expansive surface of the platform, wherein the platform comprises a drywall layer or stacked drywall layers.

17. The crown molding assembly of any one of claims 10-11 and 13-15, wherein the crown molding member and each edge-trimming bead are polymeric.

* * * * *